US008002283B1

(12) United States Patent
Jones

(10) Patent No.: US 8,002,283 B1
(45) Date of Patent: Aug. 23, 2011

(54) TARGET GAME APPARATUS

(76) Inventor: Andre W. Jones, Labelle, FL (US)

( * ) Notice: Subject to any disclaimer, the term of this patent is extended or adjusted under 35 U.S.C. 154(b) by 1292 days.

(21) Appl. No.: 11/636,329

(22) Filed: Dec. 8, 2006

Related U.S. Application Data

(60) Provisional application No. 60/748,308, filed on Dec. 8, 2005.

(51) Int. Cl.

| | |
|---|---|
| ***A63B 63/00*** | (2006.01) |
| ***F41J 1/10*** | (2006.01) |
| ***F41J 5/00*** | (2006.01) |
| ***A63B 69/00*** | (2006.01) |

(52) U.S. Cl. ..... 273/354; 273/343; 273/348; 273/407; 273/371; 473/422; 473/476; 473/435; 473/454

(58) Field of Classification Search ..... 473/422, 473/434, 435, 454, 455, 456, 476; 273/348, 273/371–372, 381, 127 R, 237, 354, 343, 273/347, 407; 436/46

See application file for complete search history.

(56) References Cited

U.S. PATENT DOCUMENTS

| | | | | |
|---|---|---|---|---|
| 5,358,253 | A * | 10/1994 | Chen | 273/348.2 |
| 5,382,028 | A | 1/1995 | Sciandra et al. | |
| 5,476,260 | A | 12/1995 | Ottley | |
| 5,873,573 | A | 2/1999 | Beatty, Jr. | |
| 5,938,202 | A | 8/1999 | Williams | |
| 6,237,918 | B1 | 5/2001 | Williams | |
| 6,251,032 | B1 | 6/2001 | Butler | |
| 6,302,809 | B1 * | 10/2001 | Yiu | 473/376 |
| 6,598,882 | B2 | 7/2003 | Stubberfield | |

* cited by examiner

*Primary Examiner* — Peter DungBa Vo
*Assistant Examiner* — Jeffrey Wong
(74) *Attorney, Agent, or Firm* — Montgomery Patent and Design; Robert C. Montgomery; Joseph T. Yaksich

(57) ABSTRACT

The present invention comprises an entertaining targeting game for all ages that enhances hand-eye coordination and provides target practice and a method of playing such a game. The device consists of an electronic target striking device for removable attachment to a ground-engaging mat. The target striking device has visual and audible strike indicating means and the mat has score display means. Additional embodiments are anticipated.

17 Claims, 5 Drawing Sheets

TARGET GAME APPARATUS

RELATED APPLICATIONS

The present invention was first described in U.S. Provisional Patent No. 60/748,308, filed on Dec. 8, 2005.

FIELD OF THE INVENTION

The present invention relates generally to a novel targeting game for all ages that enhances hand-eye coordination and provides target practice and, more particularly, to a game system, comprising an electronic target-striking device with visual and audible strike-indicating means and a score display means.

BACKGROUND OF THE INVENTION

Action games such as basketball, hockey, and the like are popular in arenas and backyards across the country. Such games are fun to watch and even more fun to play. As such, people are constantly modifying such games, changing the rules, and generally looking for the "next great thing" when it comes to such action games. As a result, manufacturers are constantly looking for modifications that allow action games to be quickly set up, allow them to be played anywhere (inside or out), can be played with a minimum of specialty equipment or gear, and are generally easy to understand with a minimum amount of rules.

The game system is an action game for two to four players. The invention consists of two goals that are placed at each end of a scoring field. Each goal is equipped with a sensor that detects when it has been struck by a ball and automatically keeps track of the score in addition to sounding an audible "hit." Each team takes turns trying to strike the opposing team's goal with a ball that is approximately the size of a basketball. Such play continues until one of the teams scores 10 points and is thus declared the winner. This novel and unique game is unique and easy to learn, while being fun to play for participants ranging from approximately age 8 through adult.

Several attempts have been made in the past to develop a gaming apparatus providing a target and an electronic and automatic scoring indication means that is portable and fun to play. U.S. Pat. No. 6,598,882, in the name of Stubberfield, discloses a web-shaped electronic device with a grounding stake, color-coded web-like attachments, and a proximity sensor. The game is played wherein a first set of players attempts to hit a second set of players with a web-like ball. Players are ousted when hit with the ball or crossing a perimeter defined by the proximity sensor.

U.S. Pat. No. 5,382,028, in the name of Sciandra et al., teaches an apparatus and method of play for a disc-tossing game, comprising two tapered containers with a slot in their sides and a dull-edged disc.

U.S. Pat. Nos. 6,237,918 and 5,938,202, both issued in the name of Williams, describe a ring-and-ball-tossing game apparatus and method for playing the same, comprising a ring-shaped element, at least two stakes, and a ball. The game is played by opposing players standing behind their respective stakes, tossing the ring-shaped element towards the opposing stake, and then tossing the ball wither towards the stake or towards the ring-shaped element, thereby accruing points based on position of the tossed ball.

U.S. Pat. No. 5,476,269, in the name of Ottley, discloses a target game for outdoor use wherein a ball is tossed or rolled towards a target, comprising a plurality of cups, which are buried within the ground. A backer board and rails are also provided to guide the ball in its tossed or rolled path.

U.S. Pat. No. 5,873,573, in the name of Beatty, Jr., teaches a ring-toss-type game, having a tubular target on a base with an upstanding central post secured with a cord to the ground and comprising a hard, heavy material that creates a sound when struck by a similarly constructed ring.

None of the prior art particularly describes a portable target-tossing game apparatus, comprising an electronic and automatic scoring mechanism. Accordingly, there is a constant need for fun action games with the above qualifications.

SUMMARY OF THE INVENTION

In view of the foregoing disadvantages inherent in the prior art, it has been observed that there is need for a portable target apparatus that includes electronic and automatic scoring indications, a method of play, and a ball for tossing at said apparatus.

It is an object of the present invention to provide a mat, further comprising a plurality of senior target attachment notches; a plurality of junior target attachment notches; a multi-section light indicator embedded within said mat; and, a scoring display also embedded within said mat.

Another object of the present invention provides for said mat to further comprise a circular shape with a center aperture and an outer ring circumscribed about the mat and molded in a different decorative color and defining a distinct outer concentric circle.

Still yet another object of the present invention provides for said senior target attachment notches to be arranged in a first broken concentric circle of a first diameter around said central aperture and said junior target attachment notches to be arranged in a second broken concentric circle of a second diameter around said central aperture, wherein said second diameter is larger than said first diameter.

Yet another object of the present invention provides for a multi-section light indicator, oriented in a third broken concentric circle of a third diameter larger than said second diameter, further comprising a plurality of illuminating lamps, affixed therewithin a plurality of lamp sockets; light indicator integral wiring, molded integrally within said mat; a first light indicator connector in electrical communication with said light indicator integral wiring; and, an outer transparent cover, covering said lamps, wherein said cover is raised slightly above the surface of the mat.

Still yet another object of the present invention provides for a scoring display, attached to an upper surface of the mat in an intermediary position between said outer ring and said multi-section light indicator, further comprising a digital LED display device; score display integral wiring molded integrally within said mat; and, a first scoring display connector in electrical communication with said scoring display integral wiring.

Another object of the present invention provides for a removably attachable senior center target and junior center target shaped as a convex upper surface and a flat lower surface, each further comprising a target dome located within said upper surface; an electronic module; a speaker; an on/off switch; a plurality of attachment tabs located about an outer circumference of said lower surface for interlocking insertion therein said senior attachment notches of said mat; a battery compartment; internal center target electrical wiring; and, an electronic cable.

Yet still another object of the present invention provides for said senior and junior target attachment notches and said senior and junior attachment tabs comprise a twist-and-lock-type fastening mechanism to ensure said senior or junior center target will remain in position even after repeated strikes by said ball.

Still yet another object of the present invention provides for a target dome manufactured out of a resilient material, wherein said target dome is able to withstand repeated strikes with said ball, while also minimizing a rebound distance of said ball after striking said target dome and further comprising a sensor, which is activated when said target dome is struck with said ball, said sensor generating and transmitting a strike signal that is electrically communicated to said electronic module.

Still yet another object of the present invention provides for an on/off switch and a battery compartment located on the lower surface of center target, wherein said on/off switch transmits power from batteries within said battery compartment to said electronic control module.

Still yet another object of the present invention provides for an electronic module located within said center target that receives said strike signal from said sensor and power from said batteries and generates an audible signal that is electrically communicated to said speaker located within said center target and projecting outwardly through said lower surface, and a score signal and a light indicator signal that are electrically communicated to said electronic cable.

Another object of the present invention provides for an electronic cable, connected at a proximal end to said electronic module and comprising a distal end with a second light indicator connector for matingly interfacing with said first light indicator connector and a second scoring display connector for matingly interfacing with said first scoring display connector, wherein said electronic cable transmits said score signal and said light indicator signal from said electronic module to said scoring display to display a score and said multi-section light indicator to activate said illuminating lamps, respectively.

To achieve the objectives mentioned above, a method of playing the target game may be achieved by performing the following steps: selecting at least one said mat for arrangement thereon a playing surface; selecting either said senior center target or said junior center target, based upon a skill level; installing a battery into said battery compartment of said senior or junior center target; installing said senior or junior center targets electrically by routing said electronic cable down through said central aperture of said mat and mating said second light indicator connector to said first light indicator connector of said multi-section light indicator and mating said second scoring display connector to said first scoring display connector of said scoring display; switching said on/off switch to an "on" position, thereby activating power to said apparatus; installing said senior or junior center target mechanically by interlocking said attachment tabs thereinto said senior target attachment notches or said junior attachment notches, respectively, and rotating said senior or junior center target in a clockwise direction to lock securely; adjusting said mat for easy viewing of said scoring display by an opposing team during play; and, commencing play.

A scoring method based on game play is achieved by performing the following steps: providing a first team and a second team, each comprised of at least one player; arranging two mats at a pre-determined distance apart from each other, based on a skill and preference of said first and second teams; selecting an endgame score based on said skill and preference; tossing said ball towards said selected senior or junior center target; striking said senior or junior center target, wherein said sensor generates a strike signal sent to said electronic module; generating and transmitting said audible signal from said electronic module through said speaker; generating and transmitting said light indicator signal and said scoring signal from said electronic module through said electronic cable and to said multi-section light indicator and said scoring display, respectively; and, declaring a winner based on either said first team or said second team first achieving said selected endgame score.

BRIEF DESCRIPTION OF THE DRAWINGS

The advantages and features of the present invention will become better understood with reference to the following more detailed description and claims taken in conjunction with the accompanying drawing in which like elements are identified with like symbols and in which:

DESCRIPTIVE KEY

Figure 1:
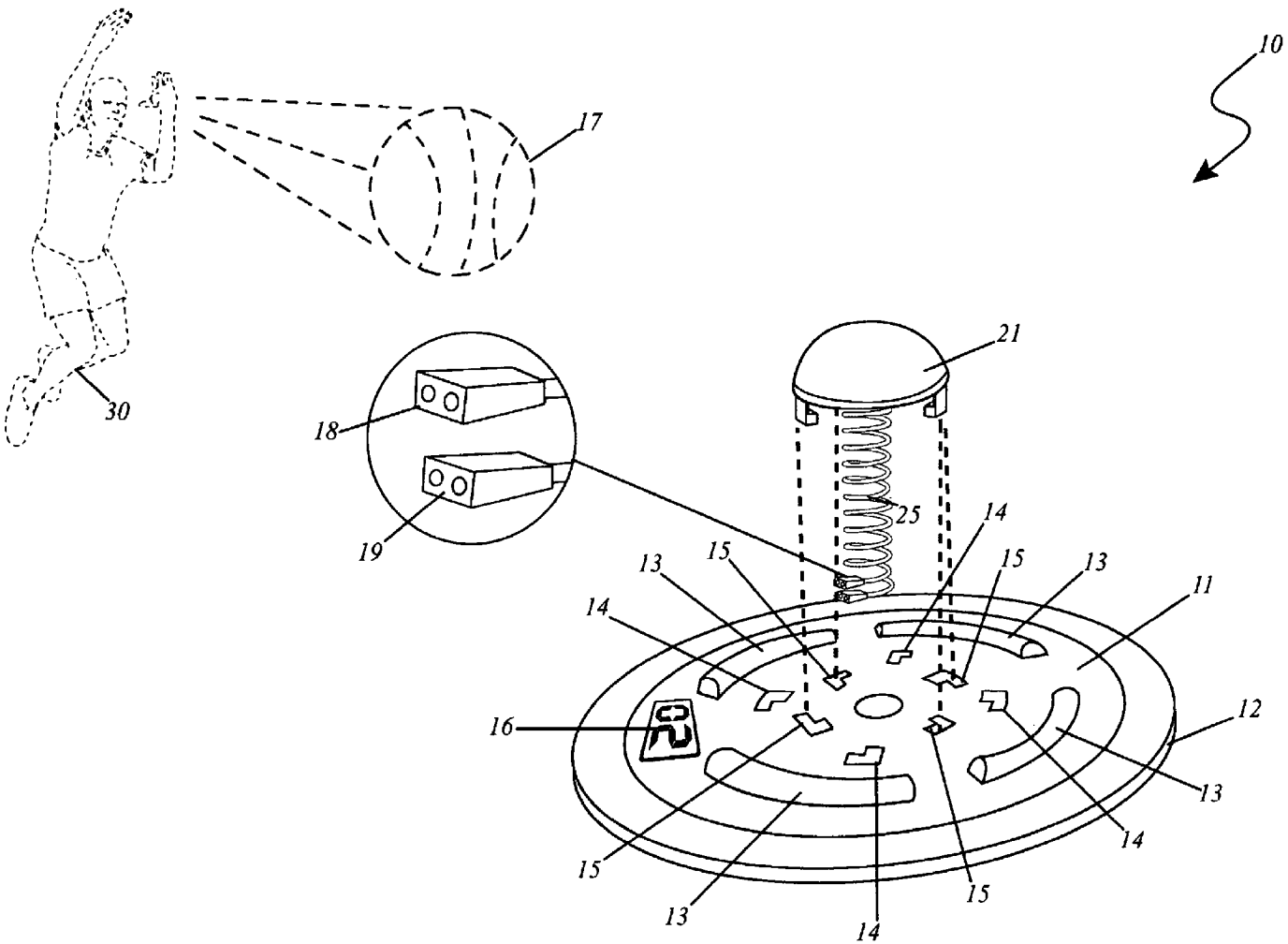
FIG. 1 is a perspective view of a targeting game 10, illustrating the senior center target 21, according to the preferred embodiment of the present invention; and, FIG. 2 is a perspective view of a targeting game 10, illustrating the junior center target 20, according to an alternate embodiment of the present invention; and, FIG. 3 is a close-up perspective view of the center target 20, 21, according to the preferred embodiment of the present invention; and, FIG. 4 is a bottom perspective view of a targeting game 10, according to the preferred embodiment of the present invention; and, FIG. 5 is an electrical schematic block diagram of a targeting game 10, according to the preferred embodiment of the present invention.

10 target game
11 mat
12 outer ring
13 light indicator
14 junior target attachment notch
15 senior target attachment notch
16 score display
17 ball
18 score display connector
19 light indicator connector
20 junior center target
21 senior center target
22 attachment tab
23 on/off switch
24 speaker
25 electronic cable
26 target dome
27 battery compartment
28 electronic module
30 game player

DETAILED DESCRIPTION OF THE PREFERRED EMBODIMENT

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a method and a targeting game 10 (herein described as the "apparatus") 10, comprising a target game system with electronic scoring as well as audible and visual indicators. The apparatus 10 comprises a mat 11, two (2) interchangeable center targets 20, 21, a contrasting outer ring 12, a multi-sectioned light indicator 13, a digital score display 16, an electronic module 28, and a ball 17.

Referring now to FIG. 1, a perspective view of the apparatus 10, according to the preferred embodiment of the present invention, is disclosed. The apparatus 10 comprises a mat 11, further comprising a plurality of senior target attachment notches 15; a light indicator 13; a scoring display 16; a removably attachable senior center target 21, further comprising a plurality of attachment tabs 22 and an electronic cable 25; and, a ball 17. The senior center target 21 is envisioned to be removably attachable to the mat 11 via an interlocking system, comprised of attachment tabs 22 and senior target attachment notches 15. The senior target attachment notches 15 are oriented as a broken concentric ring made of four (4) distinct and equidistantly-spaced attachment notches 15, which are sized to retain the corresponding attachment tabs 22 of the senior center target 21. The senior target attachment notches 15 are envisioned to be, but are not limited to, a twist-and-lock type or similar mechanism, which ensures that the senior center target 21 will remain in position even after repeated strikes by the ball 17. The senior center target 21 comprises an electronic cable 25, which provides connections and conductors to the light indicator 13 and the score display 16. The electronic cable 25 comprises a proximal end and a distal end. The proximal end of the electronic cable 25 is permanently attached to the senior center target 21. The distal end of the electronic cable 25 comprises multiple female connectors 18, 19 for interface and connection with the said visual indicators. An outer ring 12 is envisioned to be circumscribed about the mat 11 and molded in a different decorative color, defining a distinct, outer concentric circle. The outer ring 12 is further envisioned to be made of, but is not limited to, the same materials as the mat 11. The outer ring 12 comprises the same profile as the mat 11. Contained within the mat 11 is a multi-section light indicator 13, comprising illuminating lamps, required electrical components, integral wiring, and an outer transparent cover made of resilient material. The said cover is envisioned to be raised slightly above the surface of the mat 11. The light indicator 13 is envisioned to be a broken circle made of, but not limited to, four (4) distinct and equidistantly-spaced illuminating arcs. The wiring between illuminated sections of the light indicator 13 is envisioned to be molded integrally within the mat 11. The score display 16 is envisioned to be attached to the front, upper surface of the mat 11 in an intermediary position between the outer ring 12 and the light indicator 13 device. The score display 16 is further envisioned to be, but is not limited to, a digital LED device or similar technology. The provided ball 17 is envisioned to be the approximate size of a standard basketball.

Figure 2:
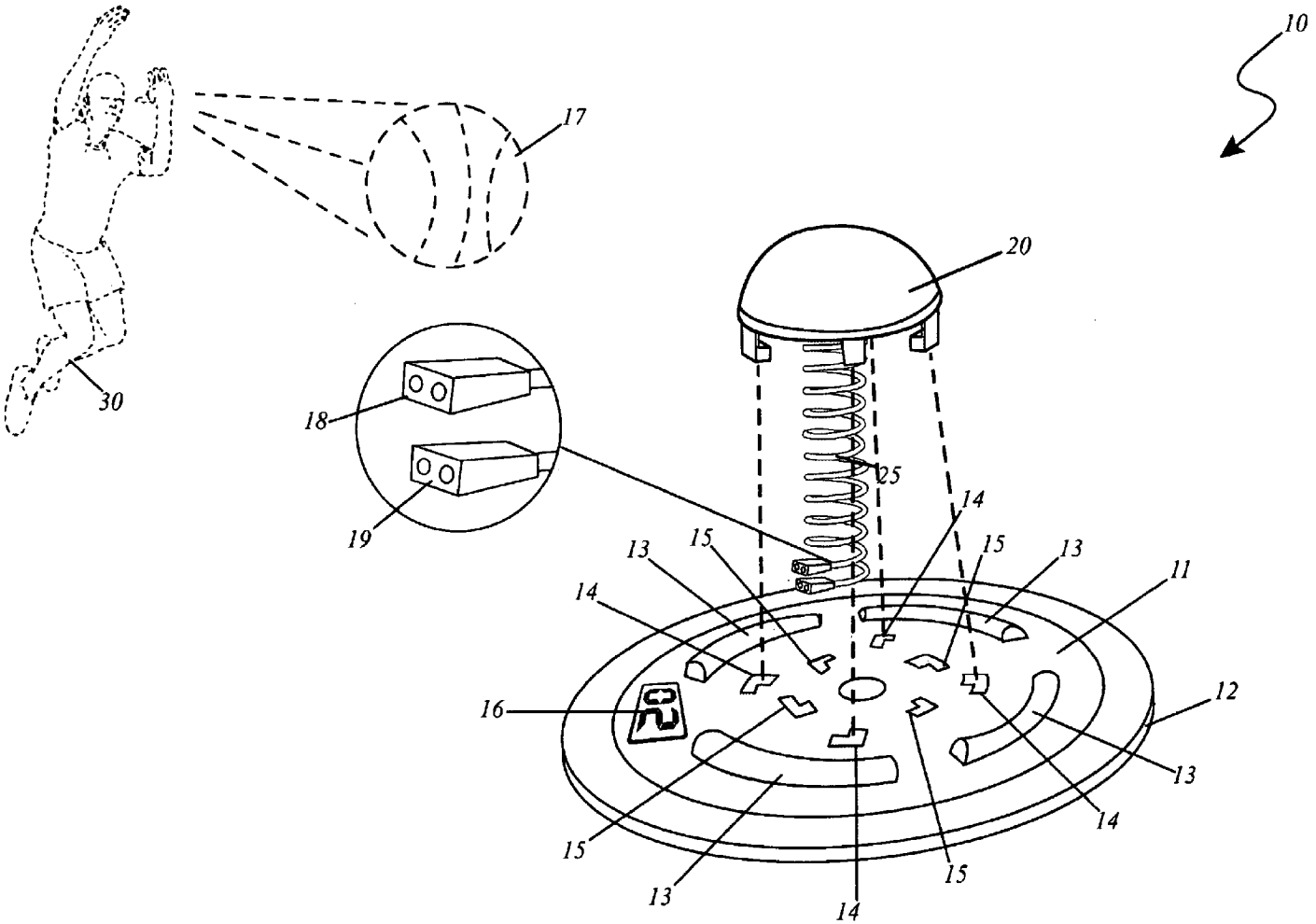

Referring now to FIG. 2, a perspective view of the apparatus 10, according to an alternate embodiment of the present invention, is disclosed. The purpose of this figure is to illustrate the attachment of the alternate junior center target 20. The alternate junior center target 20 comprises a large diameter target, corresponding attachment tabs 22, and corresponding target attachment notches 14, 15. The junior center target 20 provides a larger target with respect to the senior center target 21 and, therefore, a less challenging skill level to the player(s) 30.

Figure 3:
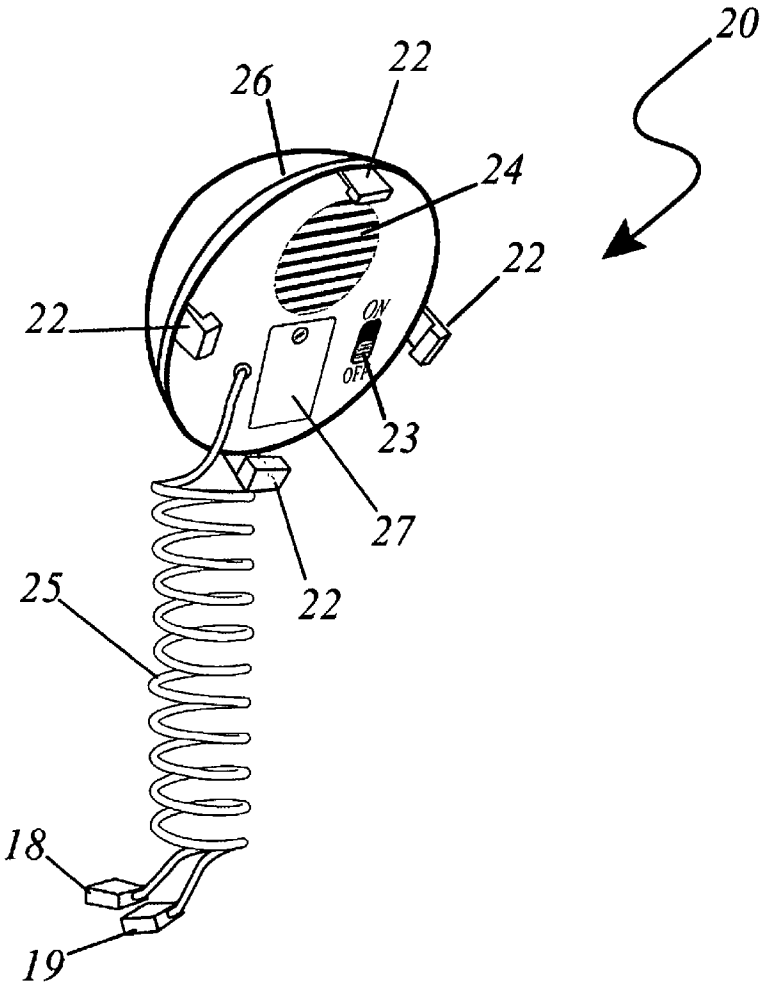

Referring next to FIG. 3, a close-up view of the center target 20, 21, according to the preferred embodiment of the present invention, is disclosed. The center target 20, 21, comprises a target dome 26, a plurality of attachment tabs 22, an electronic module 28 (see FIG. 5), an electronic cable 25, a speaker 24, an on/off switch 23, and a battery compartment 27. The target dome 26 is comprised of an approximate hemispherically-shaped construction. The target dome 26 is also envisioned to be of a resilient and sturdy construction, made of materials such as, but not limited to, rubber, foam rubber, other polymers, and the like, which are able to withstand repeated strikes with a ball 17 while also minimizing the rebound distance of the ball 17, after striking the target dome 26. The target dome 26 comprises a sensor, which is activated when the target dome 26 is struck with the ball 17. The attachment tabs 22 are envisioned to be located along the outer circumference of the bottom cover of the center target 20, 21. The attachment tabs 22 are also envisioned to stand up perpendicularly from the bottom cover and are shaped and spaced equidistantly from each other in a pattern corresponding to that of the target attachment notches 14, 15 on the mat 11. The number of attachment tabs 22 is illustrated as, but not limited to, a quantity of four (4). The electronic module 28 (see FIG. 5) receives the score signal from the target dome sensor 26 and provides signal and power to all visual and the audible indicators when the target dome 26 is struck. The electronic cable 25 provides connections and conductors to the light indicator 13 and the score display 16. The electronic cable 25 comprises a proximal end and a distal end. The proximal end of the electronic cable 25 is permanently attached to the senior center target 21. The distal end of the electronic cable 25 comprises multiple female connectors 18, 19 for interface and connection with the said visual indicators. The speaker 24 is envisioned to be formed integrally to the bottom surface of the center target 20, 21 and provides an audible indication of a score. The on/off switch 23 is also envisioned to be formed in the bottom cover of the center target 20, 21 and controls power from the battery 27, contained therein, to the said audible and visual devices.

Figure 4:
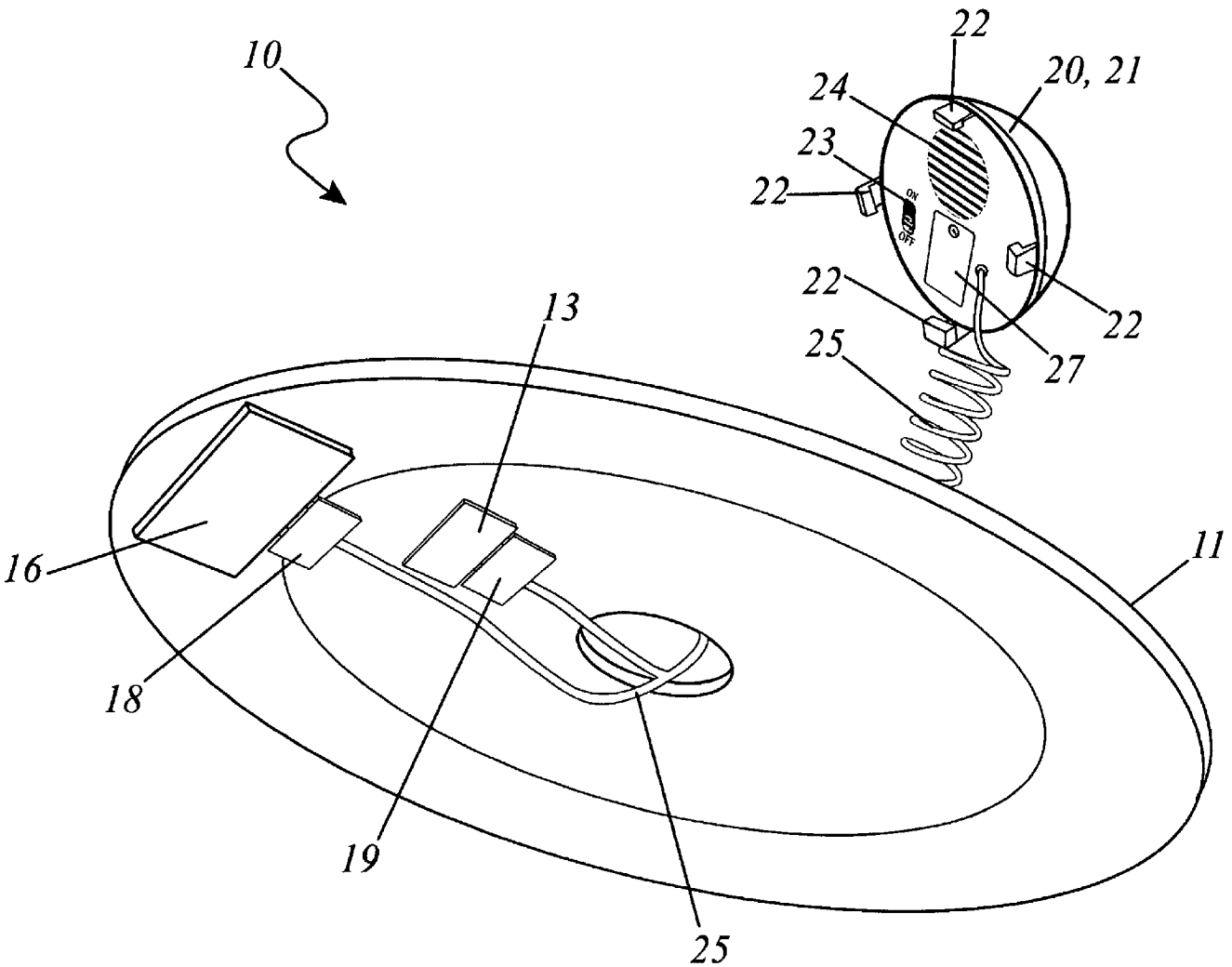

Referring next to FIG. 4, a bottom perspective view of the apparatus 10, according to the preferred embodiment of the present invention, is disclosed. The apparatus 10 comprises a mat 11, a center target 20, 21, an electronic cable 25, two (2) female connectors, a light indicator 13, and a score display 16. The mat 11 comprises an opening, thereby providing a path for routing the electronic cable 25 to the visual devices contained within the mat 11. The center targets 20, 21 comprise an electrical cord 25, which conducts signal and power to both the light indicator 13 and the score display 16. The electronic cable 25 comprises a proximal and distal end. The proximal end of the electronic cable 25 is permanently connected to the center target 20, 21. The distal end of the electronic cable 25 comprises two (2) removably attachable female multi-pin connectors 18, 19, which connect electrically and mechanically to the bottom of the light indicator device 13 and the bottom of the score display device 16. The electronic cable 25 is therefore completely hidden from view and protected from damage.

Figure 5:
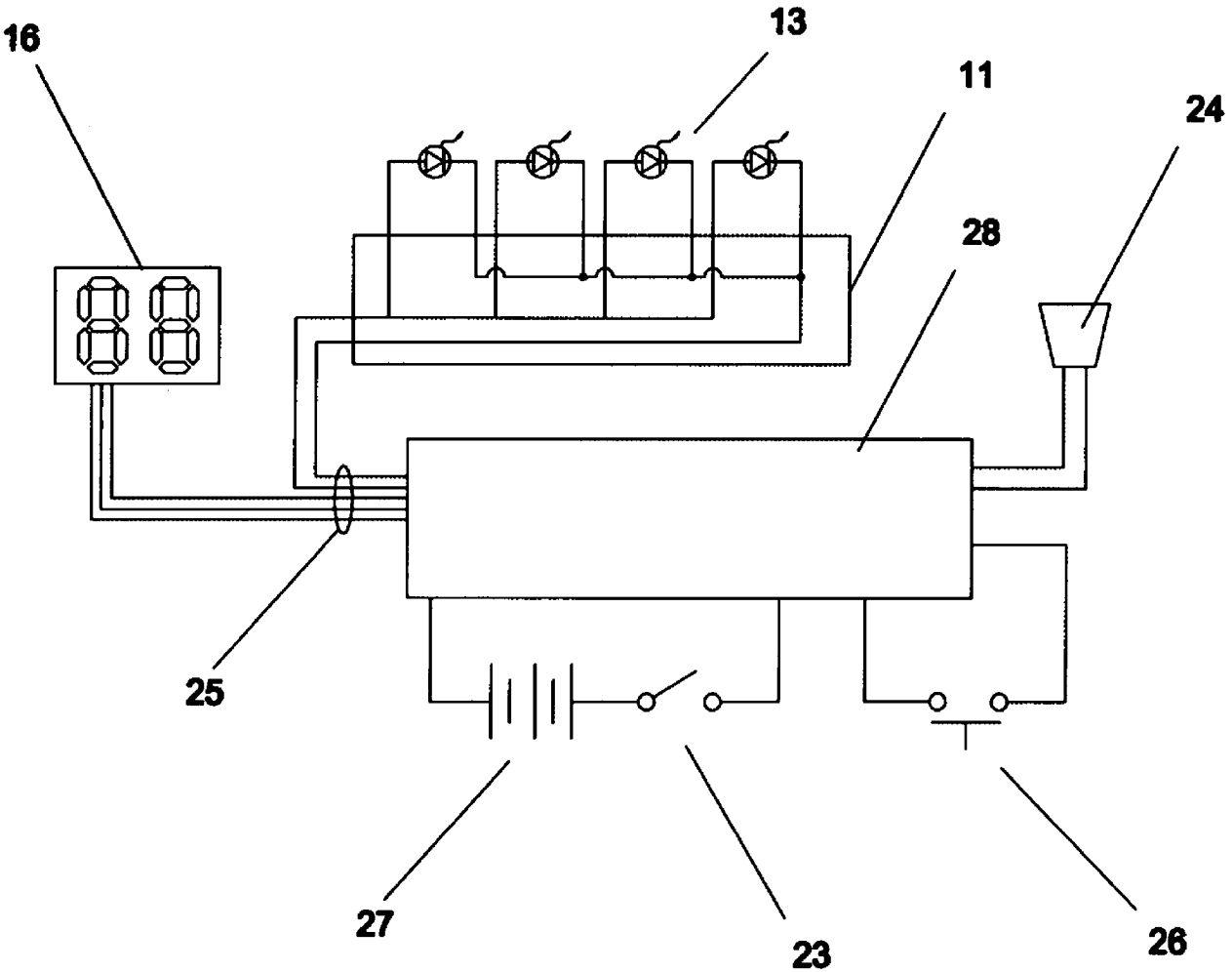

Referring next to FIG. 5, an electrical schematic block diagram depicting the electrical components as used in the apparatus 10, according to the preferred embodiment of the present invention, is disclosed. Scoring is accomplished upon the striking of the target dome 26 with the ball 17. Activation of the sensor within the target dome 26 provides a signal to the electronic module 28, thereby energizing audible and visual indicators. The electronic module 28 is contained internally to the center target 20, 21 and comprises conductors to a battery, housed within the battery compartment 27; an on/off switch 23 circuit; conductors to a speaker 24; and, an electronic cable 25. The on/off switch 23 controls power from the battery to the audible and visual devices. The speaker 24 provides an audible indication of the scoring event. The electronic cable 25 provides conductors for both signal and power to the light indicator 13 and the score display 16. The light indicator 13 comprises multiple illuminating devices, which are electrically joined together by conductors, molded integrally within the mat 11.

It is envisioned that other styles and configurations of the present invention can be easily incorporated into the teachings of the present invention, and only one particular configuration will be shown and described for purposes of clarity and disclosure and not by way of limitation of scope. The preferred embodiment of the present invention can be utilized by the common user, who has little or no training, in a simple and effortless manner. After initial purchase or acquisition of the apparatus 10, it would be installed as indicated in FIG. 1.

The method of installing the apparatus 10 may be achieved by performing the following steps: selecting (1) or more game mats 11 and arranging them on a flat surface; selecting either junior center targets 20 or senior center targets 21, based upon the desired skill level of the users; installing a battery into the battery compartment of the center target 20, 21; installing the center targets 20, 21, electrically by routing the electronic cable 25, affixed to the center target 20, 21, down through the opening in the mat 11 and attaching the electrical connector 19 to the light indicator 13 and the electrical connector 18 to the score display 16, located on the bottom side of the mat 11; switching the on/off switch 23 to the "on" position, thereby activating power to the apparatus 10; installing the center target 20, 21 mechanically by inserting the attachment tabs 22 into the target attachment notches 14, 15 and rotating in a clockwise direction to lock securely; and, adjusting the orientation of the mat 11 for easy viewing of the score display 16 by the opposing team during play.

The method of playing the game and utilizing the apparatus may be achieved by performing the following steps: arranging two (2) mats 11 and two (2) teams, at a pre-determined distance apart from each other, based on the skill and preference of the player(s) 30; selecting one (1) or more players 30 per team; scoring takes place as players 30 aim and strike the center target 20, 21, located in front of the opposing player(s) 30 with the ball 17; and, observing the accumulative team score appearing on the score display 16 as the game proceeds.

An alternate embodiment of the present invention 10 comprises a variety of center targets 20, 21, in differing sizes, thereby meeting the need for various skill levels of play.

Another alternate embodiment of the present invention 10 comprises a hoop attachment, which is mounted to the center target 20, 21, requiring an even higher skill level to score.

Yet another alternate embodiment of the present invention 10 comprises a children's version of the game, providing features such as, but not limited to, a larger mat 11 and a smaller ball 17.

Yet another alternate embodiment of the present invention 10 provides for an electrical power cord to provide power to the apparatus 10 from a conventional electrical outlet socket.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A center target removably attachable to a target mat with a convex upper surface and a flat lower surface, further comprising:

a target dome located within said upper surface;

a plurality of attachment tabs located about an outer circumference of said lower surface for interlocking insertion therein a corresponding plurality of attachment notches of said target mat;

a battery compartment located on said lower surface of said center target;

an on/off switch located on said lower surface of said center target for transmitting power from batteries within said battery compartment to an electronic module;

a speaker located within said center target;

said electronic module located within said center target;

internal center target electrical wiring; and, an electronic cable with a proximal end connected to said electronic module and a distal end.

2. The center target of claim 1, wherein said target dome is manufactured out of a resilient material able to withstand repeated strikes with a ball while also minimizing a rebound distance of said ball after striking said target dome, further comprising a sensor which is activated when said target dome is struck with said ball, said sensor generates and transmits a strike signal that are electrically communicated to said electronic module.

3. The center target of claim 2, wherein said electronic module receives said strike signal from said sensor and power from said batteries, generates an audible signal that is electrically communicated to said speaker, and generates a score signal and a light indicator signal that is electrically communicated to said electronic cable.

4. The center target of claim 3, wherein said distal end of said electronic cable further comprises a light indicator connector for matingly interfacing with a first light indicator connector on said target mat and a scoring display connector for matingly interfacing with a first scoring display connector on said target mat; wherein said electronic cable transmits said score signal and said light indicator signal from said electronic module to a scoring display to display a score and a multi-section light indicator to activate a plurality of illuminating lamps, respectively.

5. A method of playing a target game comprising a target game apparatus further comprising a mat, a center target removably attached thereto said mat, an electronic module contained therein said center target, and a ball, comprising the steps of:

providing said apparatus further comprising:

a target mat for a targeting gaming system further comprising:

a generally flexible and resilient circular shape with a center aperture;

a plurality of senior target attachment notches, wherein said senior target attachment notches are arranged in a first broken concentric circle of a first diameter around said central aperture;

a plurality of junior target attachment notches, wherein said junior target attachment notches are arranged in a second broken concentric circle of a second diameter around said central aperture, said second diameter is larger than said first diameter;

a multi-section light indicator embedded within said mat and oriented in a third broken concentric circle of a third diameter, said third diameter is larger than said second diameter;

a plurality of illuminating lamps affixed therewithin a plurality of lamp sockets;

light indicator integral wiring molded integrally within said mat;

a first light indicator connector in electrical communication with said light indicator integral wiring; and, an outer transparent cover covering said lamps, wherein said cover is raised slightly above said upper surface of said mat;

an outer ring circumscribed about the mat and molded in a different decorative color and defining a distinct outer concentric circle; and, a scoring display attached to an upper surface of said mat in an intermediary position between said outer ring and said multi-section light indicator;

a digital LED display device;

score display integral wiring molded integrally within said mat; and, a first scoring display connector in electrical communication with said scoring display integral wiring;

a removably attachable center target shaped as a convex upper surface and a flat lower surface, said center target being a senior center target or a junior center target, each further comprising:

a target dome located within said upper surface and manufactured out of a resilient material, wherein said target dome is able to withstand repeated strikes with said ball while also minimizing a rebound distance of said ball after striking said target dome, further comprising a sensor which is activated when said target dome is struck with said ball, said sensor generates and transmits a strike signal that are electrically communicated to said electronic module;

a battery compartment located on said lower surface of said center target;

an on/off switch located on said lower surface of said center target for transmitting power from batteries within said battery compartment to said electronic control module;

a speaker located within said center target;

said electronic module located within said center target that receives said strike signal from said sensor and power from said batteries, generates an audible signal that is electrically communicated to said speaker, and generates a score signal and a light indicator signal that is electrically communicated to said electronic cable;

a plurality of attachment tabs located about an outer circumference of said lower surface for interlocking insertion therein said senior attachment notches of said mat;

internal center target electrical wiring; and, an electronic cable comprising:

a proximal end connected to said electronic module; and, a distal end with a second light indicator connector for matingly interfacing with said first light indicator connector and a second scoring display connector for matingly interfacing with said first scoring display connector;

wherein said electronic cable transmits said score signal and said light indicator signal from said electronic module to said scoring display to display a score and said multi-section light indicator to activate said illuminating lamps, respectively;

selecting at least one said mat for arrangement thereon a playing surface;

selecting either said senior center target or said junior center target based upon a skill level;

installing batteries into said battery compartment of said senior or junior center target;

installing said senior or junior center target electrically by routing said electronic cable down through said central aperture of said mat and mating said second light indicator connector to said first light indicator connector of said multi-section light indicator and mating said second scoring display connector to said first scoring display connector of said scoring display;

switching said on/off switch to an "on" position, thereby activating power to said apparatus;

installing said senior or junior center target mechanically by interlocking said attachment tabs thereinto said senior target attachment notches or said junior attachment notches, respectively, and rotating said senior or junior center target in a clockwise direction to lock securely;

adjusting said mat for easy viewing of said scoring display by an opposing team during play; and, commencing play.

6. The method of claim 5, wherein the step of commencing play further comprises:

providing a first team and a second team each of at least one player;

arranging two said mats at a pre-determined distance apart from each other, based on a skill and preference of said first and second teams;

selecting an endgame score based on said skill and preference;

tossing said ball towards said selected senior or junior center target;

striking said senior or junior center target, wherein said sensor generates a strike signal sent to said electronic module;

generating and transmitting said audible signal from said electronic module through said speaker;

generating and transmitting said light indicator signal and said scoring signal from said electronic module through said electronic cable and to said multi-section light indicator and said scoring display, respectively; and, declaring a winner based on either said first or second team first achieving said selected endgame score.

7. The center target of claim 4, wherein said target comprises a senior size and junior size wherein said senior size is of a smaller size than said junior size.

8. The center target of claim 7, further comprising a hoop attachment mounted to said target dome, thereby requiring a higher skill level for striking said target dome with said ball.

9. The center target of claim 7, further comprising an electrical power cord to provide power to the center target from a conventional electrical outlet socket.

10. A targeting gaming apparatus, further comprising:

a target mat, further comprising:

a generally flexible and resilient circular shape with a center aperture;

a plurality of senior target attachment notches, wherein said senior target attachment notches are arranged in a first broken concentric circle of a first diameter around said central aperture;

a plurality of junior target attachment notches, wherein said junior target attachment notches are arranged in a second broken concentric circle of a second diameter around said central aperture, said second diameter is larger than said first diameter;

a multi-section light indicator embedded within said mat and oriented in a third broken concentric circle of a third diameter, said third diameter is larger than said second diameter;

an outer ring circumscribed about the mat and molded in a different decorative color and defining a distinct outer concentric circle; and, a scoring display attached to an upper surface of said mat in an intermediary position between said outer ring and said multi-section light indicator;

a removably attachable center target shaped as a convex upper surface and a flat lower surface, said center target being a senior center target or a junior center target, each further comprising:

a target dome located within said upper surface;

a battery compartment located on said lower surface;

an on/off switch located on said lower surface for transmitting power from batteries within said battery compartment to an electronic module;

a speaker located within said center target;

said electronic module located within said center target;

a plurality of attachment tabs located about an outer circumference of said lower surface for interlocking insertion therein either said senior attachment notches or said junior attachment notches of said mat;

internal center target electrical wiring; and, an electronic cable comprising a proximal end connected to said electronic module and a distal end.

11. The apparatus of claim 10, wherein said multi-section light indicator further comprises:

a plurality of illuminating lamps affixed within a plurality of lamp sockets;

light indicator integral wiring molded integrally within said mat;

a first light indicator connector in electrical communication with said light indicator integral wiring; and, an outer transparent cover covering said lamps, wherein said cover is raised slightly above said upper surface of said mat.

12. The apparatus of claim 11, wherein said scoring display further comprises:

a digital LED display device;

score display integral wiring molded integrally within said mat; and, a first scoring display connector in electrical communication with said scoring display integral wiring.

13. The apparatus of claim 12, wherein said target dome is manufactured out of a resilient material able to withstand repeated strikes with a ball while also minimizing a rebound distance of said ball after striking said target dome, further comprising a sensor which is activated when said target dome is struck with said ball, said sensor generates and transmits a strike signal that are electrically communicated to said electronic module.

14. The apparatus of claim 13, wherein said electronic module receives said strike signal from said sensor and power from said batteries, generates an audible signal that is electrically communicated to said speaker, and generates a score signal and a light indicator signal that is electrically communicated to said electronic cable.

15. The apparatus of claim 14, wherein said distal end of said electronic cable further comprises a second light indicator connector for matingly interfacing with said first light indicator connector on said target mat and a second scoring display connector for matingly interfacing with said first scoring display connector on said target mat; wherein said electronic cable transmits said score signal and said light indicator signal from said electronic module to said scoring display to display a score and said multi-section light indicator to activate said plurality of illuminating lamps, respectively.

16. The apparatus of claim 15, wherein said center target further comprises a hoop attachment mounted to said target dome, thereby requiring a higher skill level for striking said target dome with said ball.

17. The apparatus of claim 15, wherein said center target further comprises an electrical power cord to provide power to said center target from a conventional electrical outlet socket.

* * * * *